US005781160A

United States Patent [19]

Walton

[11] Patent Number: 5,781,160

[45] Date of Patent: Jul. 14, 1998

[54] INDEPENDENTLY FED AM/FM HEATED WINDOW ANTENNA

[75] Inventor: Eric K. Walton, Columbus, Ohio

[73] Assignee: The Ohio State University, Columbus, Ohio

[21] Appl. No.: 656,610

[22] Filed: May 31, 1996

[51] Int. Cl.[6] ..... H01Q 1/32

[52] U.S. Cl. ..... 343/713; 343/704

[58] Field of Search ..... 343/711, 712, 343/713, 704; H01Q 1/32

[56] References Cited

U.S. PATENT DOCUMENTS

| | | | |
|---|---|---|---|
| 3,964,068 | 6/1976 | Torii et al. | 343/704 |
| 4,063,247 | 12/1977 | Sakurai et al. . | |
| 4,086,594 | 4/1978 | Kropielnicki et al. | 343/713 X |
| 4,439,771 | 3/1984 | Kume et al. . | |
| 4,761,826 | 8/1988 | Kropielnicki et al. | 343/704 X |
| 5,083,133 | 1/1992 | Takayama | 343/704 |
| 5,099,250 | 3/1992 | Paulus et al. . | |
| 5,113,195 | 5/1992 | Sakurai et al. . | |
| 5,165,057 | 11/1992 | Sharples | 343/704 |
| 5,177,495 | 1/1993 | Davies | 343/704 X |
| 5,239,302 | 8/1993 | Maeda et al. | 343/713 X |

*Primary Examiner*—Donald T. Hajec
*Assistant Examiner*—Tho Phan
*Attorney, Agent, or Firm*—Frank H. Foster; Kremblas, Foster, Millard & Pollick

[57] ABSTRACT

A radio antenna formed in a vehicle window is coupled with a radio apparatus using an RF transformer having a primary winding connected between the antenna/heating element and the vehicle body and a secondary winding connected between the vehicle body and the radio apparatus. Preferably, the transformer also has a third winding which connects to a second antenna/heating element terminal for completing the electrical supply current circuit through the heating element. The primary winding and third winding are wound with identical turns and connected so the electrical heating current flowing through each winding generates a flux equal in magnitude and opposite in direction to the other to cancel the flux resulting from the heating current and thus prevent saturation of the transformer. Shunting capacitors cause RF currents through the primary winding and third winding to be equal in magnitude and in phase.

9 Claims, 6 Drawing Sheets

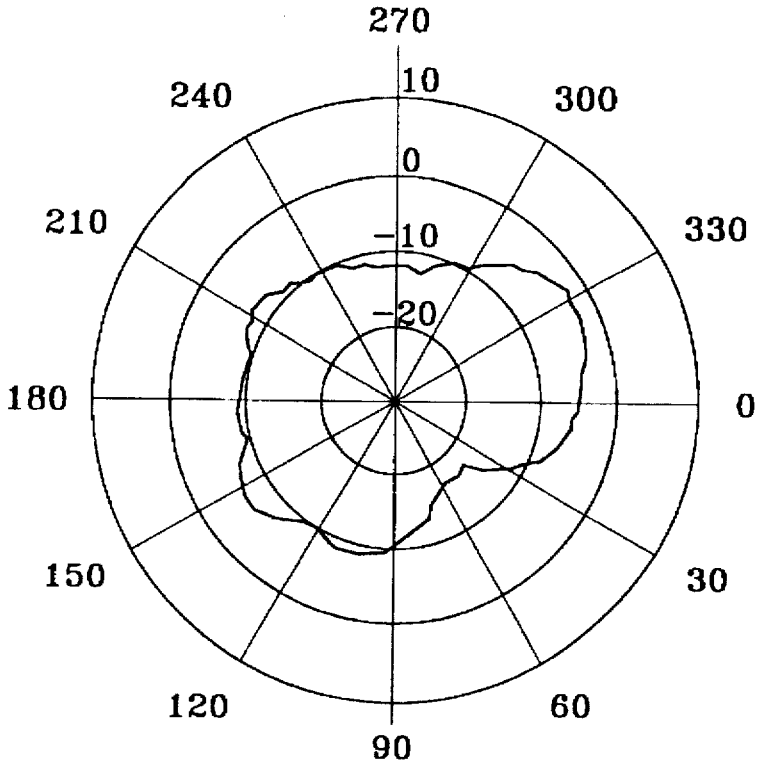
FIG−7 FREQUENCY: 89.7 MHz (FM)
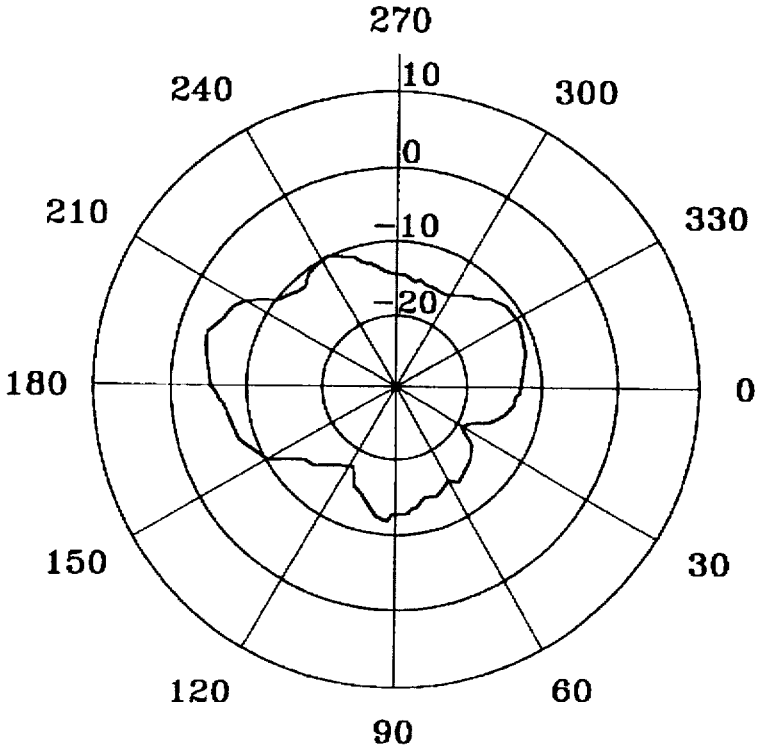
FIG−8 FREQUENCY: 97.9 MHz (FM)

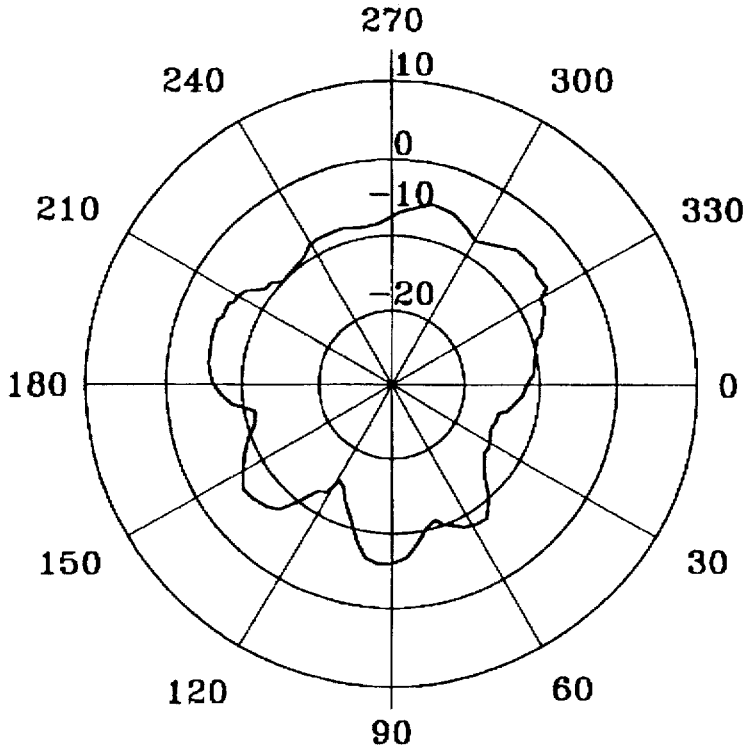
FIG−9 FREQUENCY: 99.7 MHz (FM)
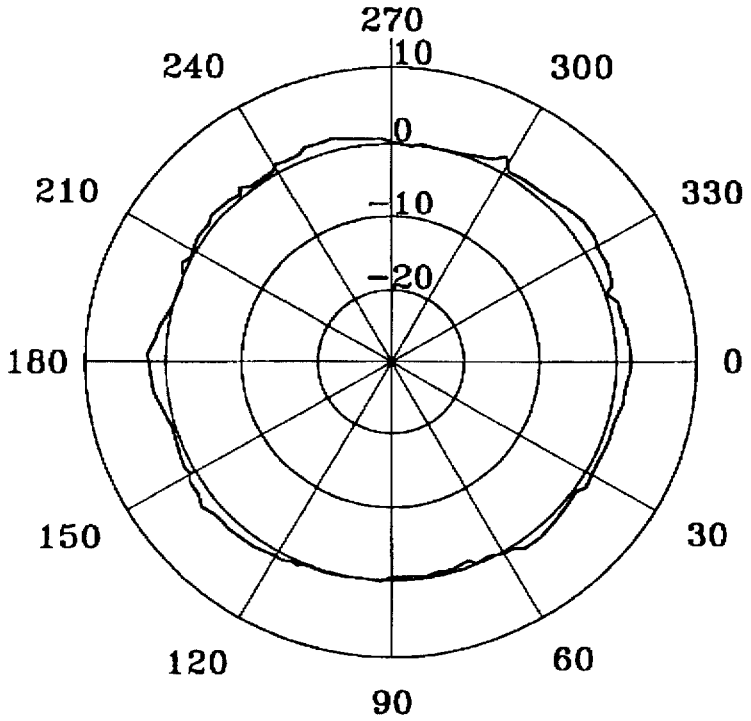
FIG−10 FREQUENCY: 610 kHz (AM)

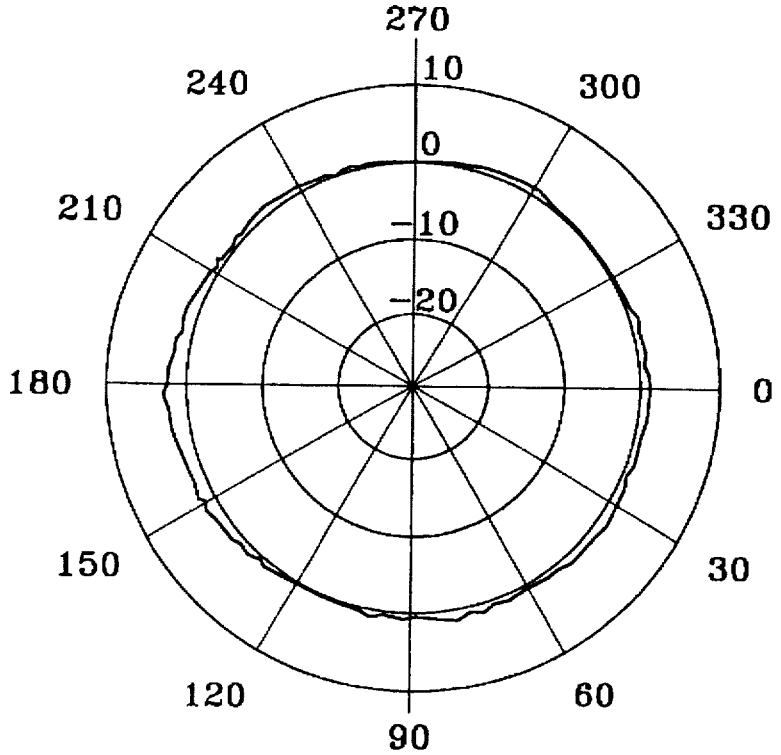
FIG−11 FREQUENCY: 820 kHz (AM)
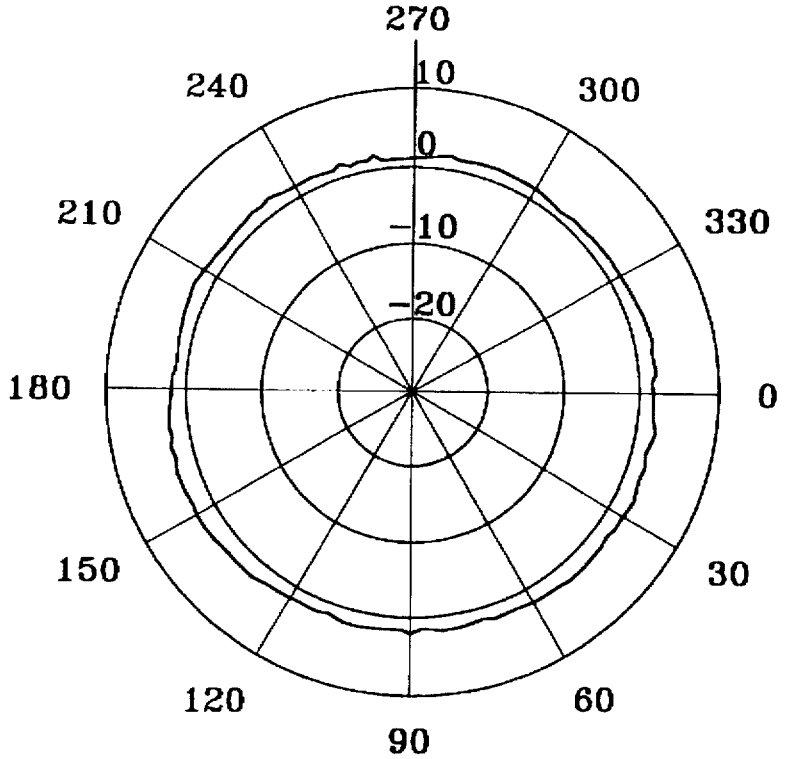
FIG−12 FREQUENCY: 1580 kHz (AM)

INDEPENDENTLY FED AM/FM HEATED WINDOW ANTENNA

TECHNICAL FIELD

This invention relates generally to antennas for wireless electronic communication and more particularly relates to the coupling of radio frequency signals between a radio apparatus and an antenna of the type composed of conductive elements formed in the glass of a vehicle window.

BACKGROUND ART

The automobile industry has long recognized the advantages of forming an antenna in a vehicle window by imbedding conductors in the window glass. Manufacturers have also recognized that such windows can be defogged or defrosted by distributing resistive conductors over a major portion of the window area. Electrical power is applied to these conductors so they become resistive heating elements within the window. Manufacturers have also recognized that the same conductors may be used for both heating the window area and as the communications antenna. Such antennas may be used not only for AM (approximately 1 MHz) and FM (approximately 100 MHz) broadcast band radios but also for other radio apparatus used for modern wireless telecommunications.

In order to utilize the same resistive conductors as resistive heaters and an antenna, the prior art has recognized that it is necessary to isolate the heater power source from radio frequency signals in order to prevent RF currents from being shorted through the vehicle or heater power system.

Typically, this isolation is accomplished in the manner illustrated in FIG. 1. Referring to FIG. 1, the resistive conductors 10 form an antenna element mounted to a transparent window 12 which is itself mounted in an aperture through a conductor, typically steel, sheet 14 which forms a part of a vehicle body. One typical form of antenna element 10 comprises a plurality of horizontal, parallel, closely spaced resistive conductor elements joined together at their ends by a conductive bus strips 16. The typical source of electrical heating current is the vehicle DC generator, DC alternator or battery 18, although it may alternatively be a relatively low frequency AC source, conventionally of 60 Hz or 400 Hz. In order to provide electrical current to the antenna/heater 10 for resistive heating while preventing shorting of the radio frequency (RF) signals, electrical current is supplied from the vehicle battery 18 through a series connected RF choke 20 and through a second series connected RF choke 22 connected to ground which is typically the conductive sheet 14 and the entire vehicle body.

A coupling capacitor 24 is used to couple RF currents between the antenna and a radio apparatus 26 while blocking DC or low frequency currents generated by the electrical source of heating current. Such capacitors may be configured in a number of conventional ways.

The problem with the structure illustrated in FIG. 1 is that the RF chokes 20 and 22 must be effective from the bottom of the AM frequency band to the FM frequency band. The AM band extends approximately from 500 KHz to 1600 KHz, so that the chokes must provide effective power isolation at a frequency as low as 500 KHz. Since the input impedance of the antenna and of the radio apparatus at these broadcast frequencies is greater than 3000 ohms, the reactive impedance of the chokes must be at least greater than 6000 ohms even at 500 KHz in order for the chokes to be effective or useful. Consequently, such chokes must have an inductance of greater than 1 mH and must carry current of up to 20 amps at 12 volts DC. As a result, such chokes must be relatively large and heavy, and are expensive. If a ferrite core is used to attempt to increase the inductance of the choke and thus reduce the cost and weight, the large currents induce large values of magnetic flux which can saturate the ferrite core. Also, if large non-ferrite chokes are designed to work at 500 KHz, they typically permit parasitic capacitive leakage at the FM band frequency which is approximately from 88 MHz to 108 MHz.

U.S. Pat. No. 5,083,133 illustrates an antenna feed system which utilizes a three winding transformer on a ferrite, toroidal core. The pair of primary windings conduct the DC heating current in opposite directions through the bifilar windings to provide DC current feed to the defogger/antenna which cancels the flux in the transformer to avoid core saturation. A secondary provides an AM RF signal to the radio through transformer action. The patent illustrates a separate FM antenna. U.S. Pat. No. 4,439,771 also illustrates the use of two different antennas formed in the window, one for AM and the other for FM.

U.S. Pat. Nos. 4,063,247 and 5,113,195 show use of conventional choke coils and a single AM and FM feed. U.S. Pat. No. 5,113,195 also includes a capacitor to minimize loss or leakage of the RF signals.

The difficulty with these prior art antennas is that they do not provide for or permit separate and independent variation and control of the field pattern and impedance for the higher frequency FM signals and the lower frequency AM signals except by the use of two separate, different antennas.

It is an object and feature of the present invention to permit the use of a single antenna while also permitting separate optimization of the impedance matching for the AM and FM bands or other relatively lower and higher frequency bands and similarly separate, independent optimization of the field patterns for both bands.

It is another object feature and advantage of the present invention to couple RF signals between the antenna/heater and a radio apparatus with electrical components having reduced size, weight and cost as compared to the conventional prior art radio frequency choke systems.

BRIEF DESCRIPTION OF INVENTION

The present invention uses an RF transformer having a primary winding connected between an antenna terminal and ground and having a secondary connected between the ground and the radio apparatus for feeding the lower frequency AM signals to the radio apparatus. The invention further includes a transmission line connected through a capacitor between the antenna and the radio apparatus for feeding the higher frequency FM signals from a different antenna location than that from which the AM signal is fed.

This combination allows separate, independent tuning of the FM and AM parameters to optimize both the impedance and field patterns separately for AM and FM. For example, the turns ratio and self-impedance of the transformer may be varied to optimize impedance matching, and therefore the coupling efficiency at AM frequencies. The position of the FM feed point on the antenna may be varied to optimize the field pattern and preferably make it as omnidirectional as possible. One or more tuning stubs can also be located on the antenna for tuning the antenna at FM frequencies in order to optimize coupling efficiency.

BRIEF DESCRIPTION OF DRAWINGS

FIGS. 7–12 are plots of azimuthal gain patterns for the AM and FM broadcast bands using the embodiment of FIG. 6.

Figure 1:
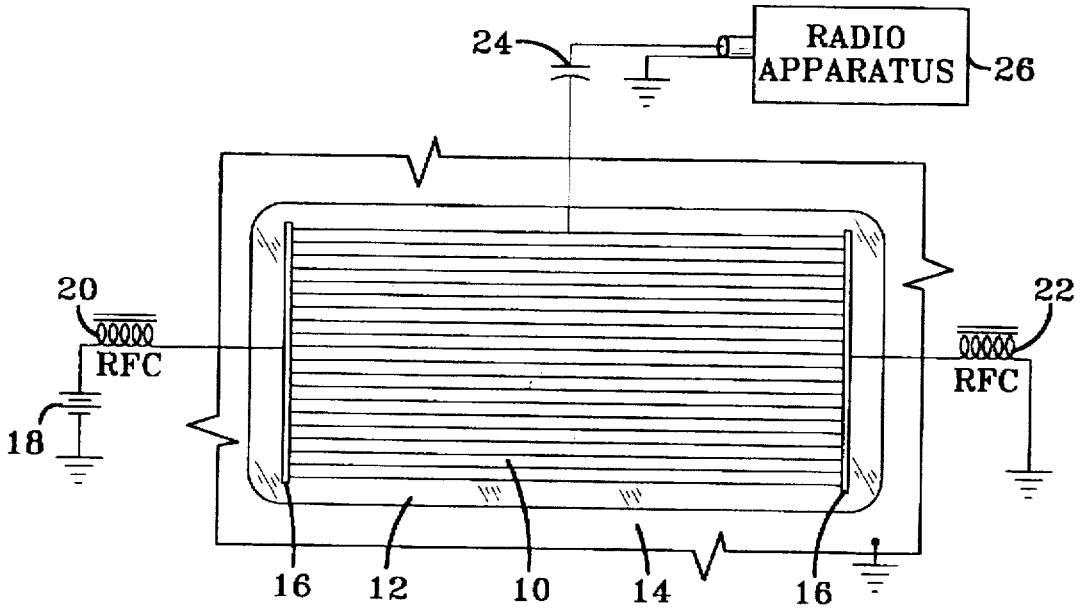
FIG-1 PRIOR ART
FIG. 1 is a schematic diagram illustrating a window antenna/heater coupled to an electrical source of heating current and a radio apparatus in accordance with the prior art.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art. In addition, many circuits are illustrated which are of a type which perform well known operations on electronic signals. Those skilled in the art will recognize that there are many, and in the future may be additional, alternative circuits which are recognized as equivalent because they provide the same operations on the signals.

DETAILED DESCRIPTION

Figure 2:
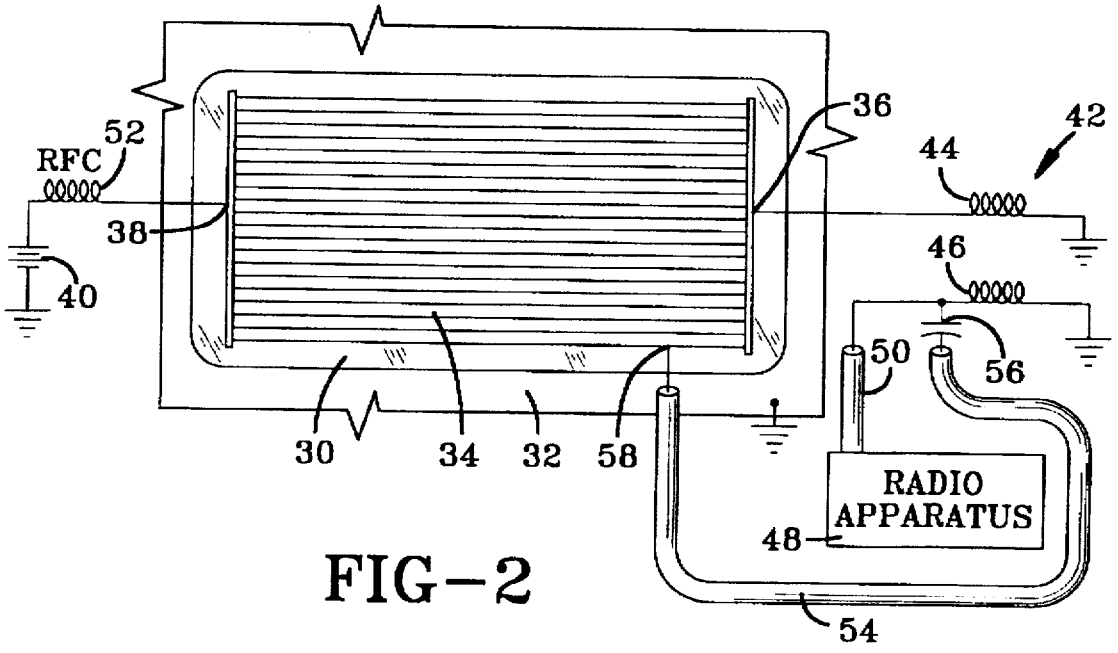
FIG. 2 is a schematic diagram illustrating a first embodiment of the invention.

FIG. 2 illustrates an embodiment of an invention formed in a window 30 mounted in an aperture in a conductive sheet 32 which is typically the steel body of a vehicle. The antenna, like the antenna of FIG. 1, is a combination heater and antenna. The antenna 34 is mounted to the window 30 and has a first terminal 36 and second terminal 38 for connection to a source 40 of heating current.

An RF transformer 42 has a primary winding 44 connected between the first antenna terminal 36 and the conductive sheet 32. The transformer 42 also has a secondary winding 46 for feeding the lower frequency AM signals. The secondary winding 46 is connected between the conductive sheet 32 and a radio apparatus 48 through a conventional coaxial transmission line 50. The electrical source 40 of heating current is connected to the second terminal 38 of the antenna 34 through a radio frequency choke 52. The transformer 42 used in the embodiment of FIG. 2 has an air core because the DC heating current would cause a ferromagnetic core to saturate. The higher frequency FM signal is fed to the transmission line 50 and by it to the radio apparatus 48 by a coaxial transmission line 54, which is series connected to a capacitor 56. The feed point 58 on the antenna 34 is selected to optimize the feed parameters in accordance with the conventional design goals. In this, as in all embodiments of the invention, it will be apparent to those skilled in the art that an equivalent connection is the connection of the electrical source 40 through the primary winding 44 to the first terminal 36 and the connection to ground of the second terminal 38 through the RF choke 52. Additionally, the RF transformer may be connected to the conductive sheet or ground either directly or through the electrical source of heating current.

In the operation of the embodiment of FIG. 2, instead of connecting an RF choke to the first terminal 36 of the antenna element 34, the RF current passes through the primary winding 44 and is inductively coupled to the secondary 46 to the radio apparatus 48. Since the RF transformer can be constructed with considerably fewer turns than an RF choke, it may be smaller in size, weight and cost than the RF choke it displaces because large inductive values are not required.

Figure 3:
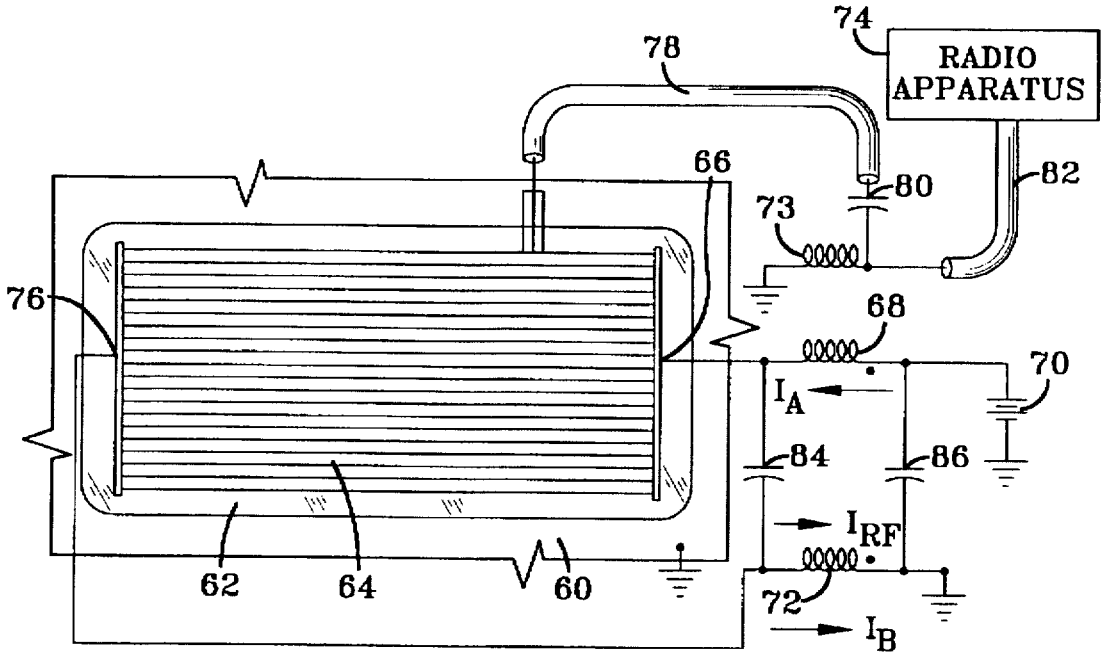
FIG. 3 is a schematic diagram illustrating an alternative and preferred embodiment of the invention.

FIG. 3 illustrates an embodiment which eliminates the need for any RF choke in many embodiments and also permits the use of a ferrite core in the RF transformer while preventing saturation of that core. FIG. 3 illustrates a conductive sheet 60 having a window 62 with an antenna 64 formed on the window 62. As in the embodiment of FIG. 2, a first antenna terminal 66 is connected through a primary winding 68 to an electrical source 70 of heating current. Also in the manner illustrated in the embodiment of FIG. 2, a secondary winding 73 is similarly connected between the grounded conductive sheet 60 and the radio apparatus 74. However, a third winding 72 in flux linkage with the primary winding 68 and the secondary winding 73 is connected between the second antenna terminal 76 and the grounded side of the electrical source 70. A coaxial transmission line 78 is connected through a capacitor 80 between the antenna 64 and the radio 74 through a coaxial transmission line 82.

In the operation of the circuit of FIG. 3, the electrical heating current, designated $I_A$ and $I_B$, flows through the coils in such a direction as to generate opposed substantially equal magnetic flux from the heating current. Consequently, the magnetic flux of the primary winding and the magnetic flux of the third winding are in opposite directions and equal The equal but opposite flux of the primary winding 68 and third winding 72 cancel so that the flux generated by the heating current cancels and therefore does not saturate the core.

As is known to those skilled in the art, this flux cancellation effect may be obtained through the direction of winding or direction of connection of the coils. Preferably, the coils are wound together in a bifilar or a trifilar manner to optimize the coupling and ensure that the primary winding and third winding have identical characteristics to result in identical flux.

Although the heating current flux components are oppositely directed and cancel, the AM RF signal currents flowing from the antenna element 64 to the conductive sheet ground, flow in an additive direction as illustrated by IRF on FIG. 3. These AM RF currents add in phase in the transformer.

A capacitor 84 is connected across the antenna terminals between one side of both the primary winding 68 and the third winding 72. Similarly, a capacitor 86 is connected between the primary winding 68 and third winding 72 on the side of the windings opposite the antenna terminals. These capacitors 84 and 86 form a radio frequency short to assure that the RF currents in the primary winding 68 and the third winding 72 are equal in magnitude and in phase while having no effect upon the heating current. The result is that there is an RF magnetic field in the core of the transformer for coupling the AM RF signal with the radio apparatus with only a negligible magnetic field resulting from the large heating currents.

Since the secondary winding 73 carries only very small RF currents, it may be wound from a wire having a substantially smaller diameter than the wire used for the primary winding and the third winding. of course, the turns ratio between the secondary winding 73 and the primary winding 68 may be adjusted to optimize the coupling and match the antenna and radio input impedances.

For example, a toroidal core having a 2 inch outer diameter, 1¼ inch inner diameter and a thickness of 0.5 to 0.75 inches, was utilized having a primary winding and a third winding of 20 turns constructed of 18 gauge wire. A secondary winding having 20 turns of considerably smaller wire was also used. Typically, the primary winding and the third winding would have 20–30 turns and would be expected to carry 20–25 amperes. The capacitors 84 and 86 would typically be 150–250 pf. The capacitor 80 would typically be 10–60 pf.

Figure 4:
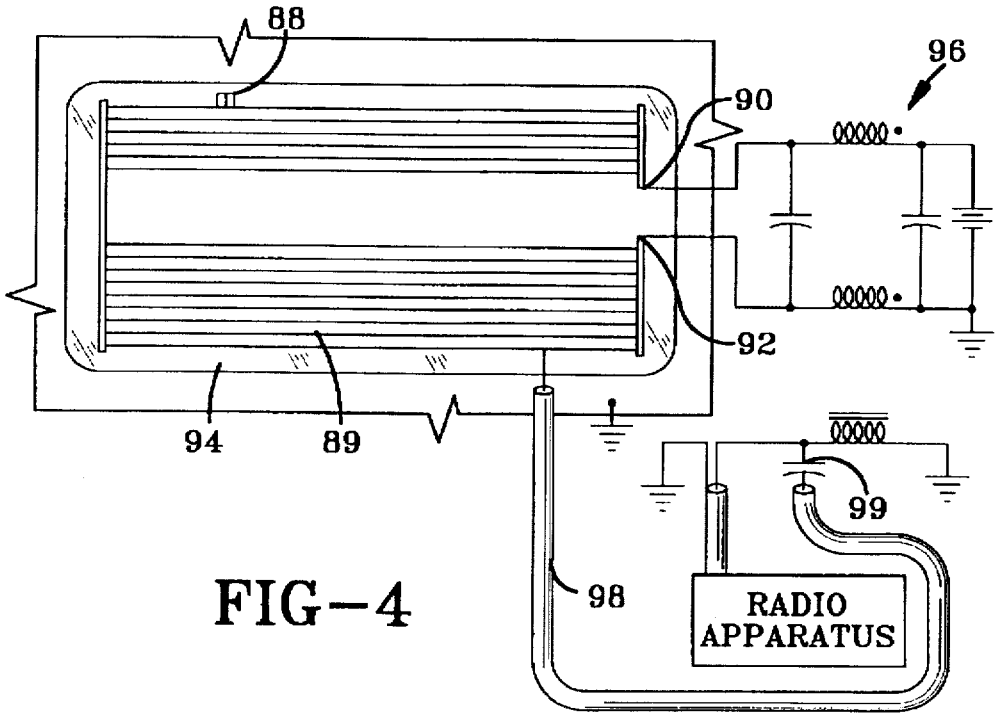
FIG. 4 illustrates another alternative embodiment of the invention.

FIG. 4 illustrates an embodiment in which the antenna/heater 89 is implemented with the first antenna terminal 90 and the second antenna terminal 92 located near each other in the same region of the window 94. In this embodiment, the electrical circuitry including the transformer 96, the transmission line 98 and capacitor 99 may be identical to those illustrated in connection with FIG. 3.

FIG. 4 also illustrates use of an additional tuning stub 88 for tuning the impedance of the antenna 89. The stub is an extension of the antenna selected to modify the antenna impedance to more closely match the input impedance of the FM transmission line and radio apparatus at FM frequencies to the antenna impedance. A tuning stub may also be formed at the FM feed point on the antenna as illustrated in FIG. 3 for the same purpose.

Figure 5:
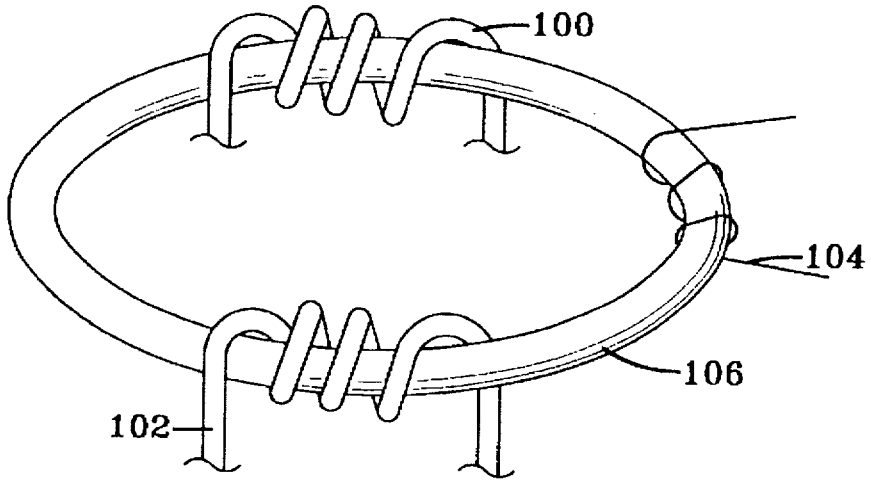
FIG. 5 illustrates a toroidal transformer utilized in embodiments of the present invention.

FIG. 5 is a simplified diagram of three windings 100, 102 and 104 wound on a ferrite toroid 106 to form a transformer for use with embodiments of the invention. These windings may be formed in a bifilar or trifilar manner.

Figure 6:
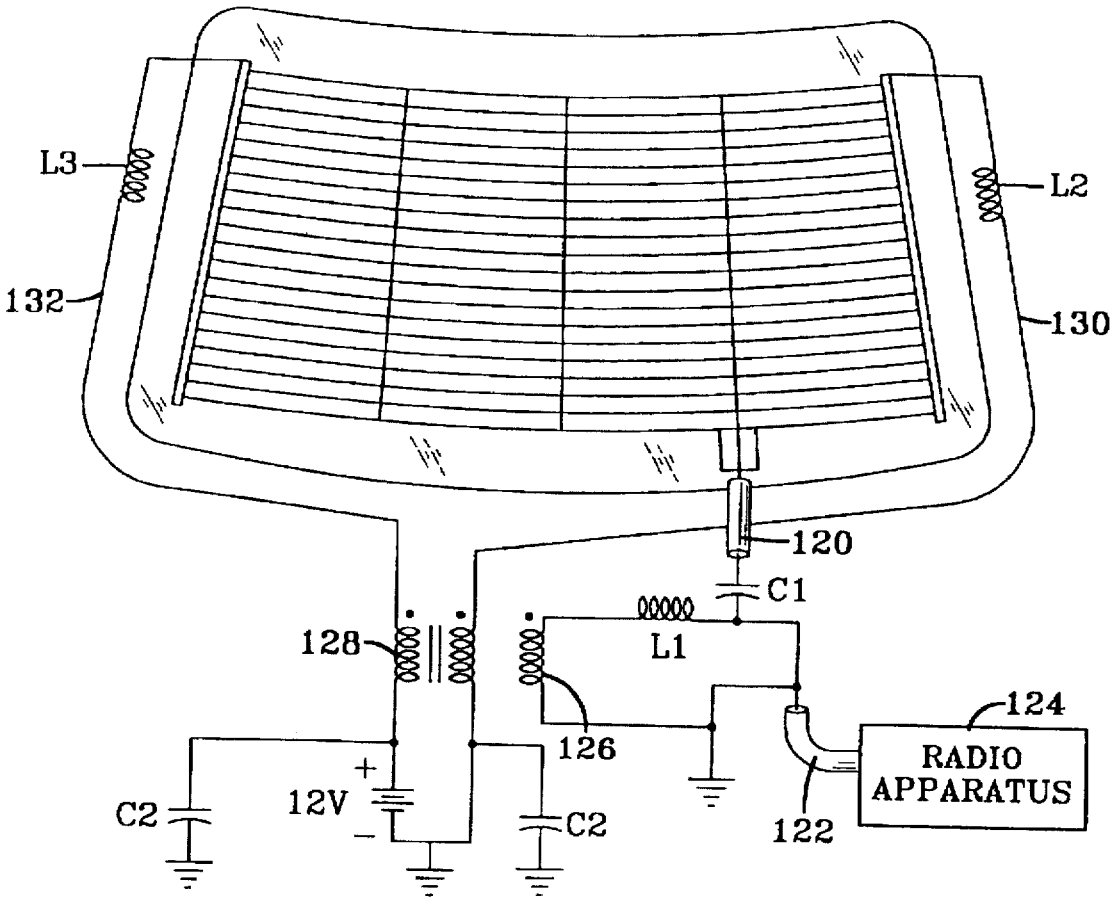
FIG. 6 is a diagram of an alternative embodiment of the invention.

FIG. 6 illustrates an embodiment of the invention to which additional isolation chokes have been added. In FIG. 6, capacitor Cl is used to couple the FM signal from the coaxial transmission line 120 to coaxial transmission line 122 for feed into the radio 124 and capacitors C2 are used for noise suppression. In addition, FM choke Li has been interposed between the coaxial transmission line 122 and the transformer secondary 126. The choke Li is used if the inductance of the windings of transformer 128 is insufficient to block the higher frequency FM signals. Of course, choke Li must have a sufficiently low inductance that it does not block the relatively lower frequency AM signals. Additional chokes L2 and L3 may also be interposed in the DC heating current feed conductors 130 and 132 to present a high impedance to the FM signals to prevent RF coupling to the vehicle chassis if necessary.

Azimuthal gain patterns were measured for the embodiment of FIG. 6 installed on a passenger automobile. These commercial broadcast data were obtained by driving the automobile through a full 360° circle with approximately 50 foot radius with data taken in sequence at angularly spaced intervals and calibrated to a 30 inch monopole antenna placed on the center of the roof of the automobile. This was repeated for each of the three representative frequencies in each of the two broadcast bands. The results are represented in FIG. 7–12.

While certain preferred embodiments of the present invention have been disclosed in detail, it is to be understood that various modifications may be adopted without departing from the spirit of the invention or scope of the following claims.

I claim:

1. An antenna and feed circuit for coupling an electromagnetic signal to a radio apparatus and comprising:

a) an antenna mounted to a window formed in an aperture through a conductive sheet connected to a ground, the antenna also being a resistive heating element and having first and second terminals for connection to an electrical source of heating current;

b) an RF transformer capable of passing and inductively coupling RF signals, the transformer having a primary winding connected between said first antenna terminal and said ground and having a secondary winding connected between said ground and said radio apparatus for feeding lower frequency signals; and c) a transmission line connected through a capacitor between said antenna and said radio apparatus for feeding higher frequency signals.

2. An antenna in accordance with claim 1, wherein said lower frequency signals are in the AM broadcast band and said higher frequency signals are in the FM broadcast band.

3. An antenna in accordance with claim 2, wherein an RF choke is interposed in series between the second terminal of the antenna and the heating current source.

4. An antenna in accordance with claim 2, wherein the RF transformer has a third winding in flux linkage with the primary winding and the secondary winding and conductively connected between the second antenna terminal and the source of heating current, said primary winding and said third winding having the same number of turns and being connected to generate a substantially equal and opposite magnetic flux resulting from the heating current.

5. An antenna in accordance with claim 4, wherein a capacitor is connected across the antenna element terminals to equalize the amplitude and phase of the RF currents through the primary winding and third winding.

6. An antenna in accordance with claim 5, wherein a second capacitor is connected between the primary winding and third winding on the side of the windings opposite the antenna terminals.

7. An antenna in accordance with claim 4 wherein the third winding is fabricated from a smaller diameter wire than the primary and secondary windings.

8. An antenna in accordance with claim 4 wherein an FM tuning stub is connected to the antenna for optimizing the impedance match of the antenna with the radio apparatus.

9. An antenna in accordance with claim 4 wherein the connection of the transmission line to the antenna is at a selected location on the antenna to optimize the symmetry of the antenna field pattern.

* * * * *